United States Patent [19]

Ayabe et al.

[11] Patent Number: 4,712,702

[45] Date of Patent: Dec. 15, 1987

[54] CONTAINERS FOR BEVERAGES

[76] Inventors: Youzou Ayabe, Imperial Roppongi 406, 16-5, Roppongi 5-chome, Minato-ku, Tokyo; Shigeru Sugiyama, 8-7, Kugenumakaigan 3-chome, Fujisawa-shi, Kanagawa-ken, both of Japan

[21] Appl. No.: 922,222

[22] Filed: Oct. 23, 1986

[51] Int. Cl.[4] ..... A47G 21/18; A47G 19/22; B65D 47/04

[52] U.S. Cl. ..... 220/90.2; 215/1 A; 229/7 S

[58] Field of Search ..... 220/90.2; 229/7 S; 215/1 A

[56] References Cited

U.S. PATENT DOCUMENTS

| | | | |
|---|---|---|---|
| 2,613,988 | 10/1952 | Jarbeau | 215/1 A |
| 3,349,955 | 10/1967 | Cornealius | 220/90.2 |
| 3,656,654 | 4/1972 | Brinkley | 229/7 S |
| 3,717,476 | 2/1973 | Harvey | 220/90.2 |
| 4,356,927 | 11/1982 | Cooper | 220/90.2 |

*Primary Examiner*—George E. Lowrance

*Attorney, Agent, or Firm*—Browdy and Neimark

[57] ABSTRACT

Disclosed is a container for beverages such as soft drinks, beer, etc. which houses therein a straw of which the upper end is mounted on the rear side of an opening of a container body. A stopper is provided at the lower portion of the straw to prevent the latter from being slipped out.

1 Claim, 7 Drawing Figures

CONTAINERS FOR BEVERAGES

BACKGROUND OF THE INVENTION

1. Field of the Invention

The present invention relates to containers for beverages, and particularly to a container for beverages such as metal cans, paper cans, composite cans, etc. which contain soda, beer, and soft drinks such as fruit juice, vegetable juice or the like.

2. Description of Prior Art

In the past, among containers for beverages of this kind, for example, in a container with an easy-open end, a top plate is bored with an outlet by a ring tab, a reverse tab or the like, and a mouth is placed directly against the outlet to drink or a separately prepared straw is inserted into the container to drink.

However, there has been encountered problems that particularly in the case where the top plate is made of metal, the outlet has a sharp cut end and therefore if the mouth is placed against the outlet, there is a danger of cutting a lip, and that directly placing the mouth against the outlet is unsanitary.

In addition, the insertion of a straw into the container always entails the preparation of the straw, which is cumbersome.

In order to overcome these problems, there has been proposed a container which houses therein a straw. However, it is not only difficult to remove a straw but when a beverage is sealed into a container while the latter is being manufactured, it is cumbersome to incorporate a straw therein, which is not practical.

Moreover, in prior art, the length of a straw is shorter than the depth of a container, and the straw becomes sunk therein. In addition, there was a further proposal in which a straw is formed spirally so that when a container is opened, the upper part of the straw jumps up. However, this involves an inconvenience in use or there poses a problem in manufacture.

Furthermore, prior art proposals have problems that a straw easily slips out of an outlet and becomes lost, and that when a used container is discarded, a straw falls into pieces, and one is at a loss for disposal thereof.

SUMMARY OF THE INVENTION

The present invention has been achieved in order to solve these problems noted above with respect in prior art. It is an object of the invention to provide a container for beverages in which a straw is housed in the container and one can drink juice or the like safely and hygiencially without directly placing one's mouth against the drinking opening, and in which a straw may be removed positively and simply at the same time a discharge opening or an outlet is opened.

It is a further object of the invention to provide a container for beverages in which a straw may be extended simply and positively to render drinking easy.

It is another object of the invention to provide a container for beverages in which a container may be discarded for disposal in a state wherein a straw is positively stayed therein to be useful for prevention of public hazards.

BRIEF DESCRIPTION OF THE DRAWINGS

FIG. 1 is a sectional view showing one embodiment of a container for beverages according to the present invention, in which

FIG. 2 is a fragmentary enlarged sectional view in a state wherein a straw is caulked against a tearing opening of the top plate, in which

DESCRIPTION OF THE PREFERRED EMBODIMENTS

An embodiment of the present invention will be described hereinafter with reference to the accompanying drawings.

Figure 1:
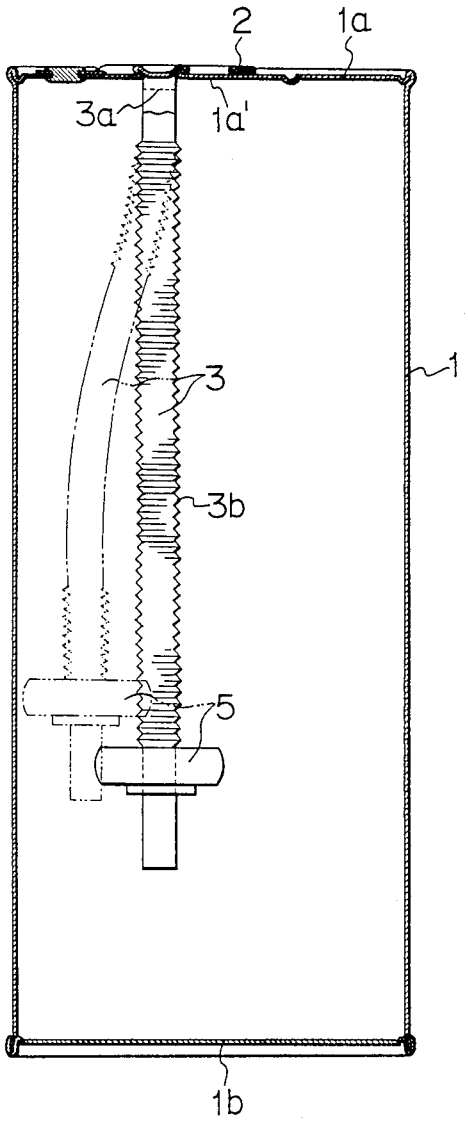
Figure 1A:
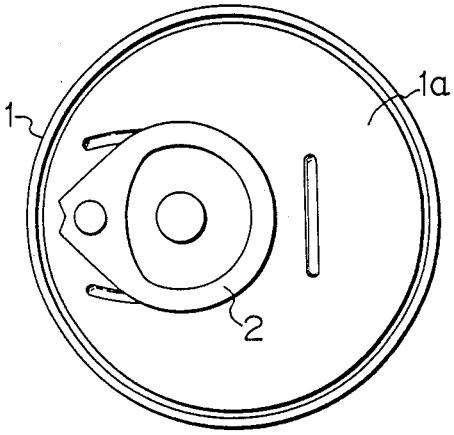
FIG. 1A is a top view of a top plate and FIG. 1B is a rear view of the top plate.
Figure 1B:
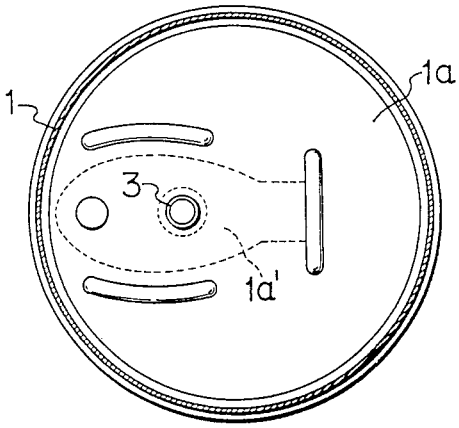

Referring now to FIG. 1, a container body indicated at 1 is molded from a metal sheet into a tubular configuration, of which upper and lower ends are integrally formed with a top plate 1*a* and a bottom plate 1*b* by caulking (rolling) or the like. It is noted that the container body 1 can be formed of materials such as paper, composite material, etc. other than the aforesaid metal sheet, and can be of shape and construction such as a polygonal tube, a box, a beer barrel, a bottle, a spherical body, etc. other than the aforesaid tubular body. In short, any of material, shape and construction may be employed as long as the container is one which can seal beverages therein.

The top plate 1a is in the form of a so-called easy-open end in which a tearing line is incorporated to form a tearing opening 1*a*'. A ring tab 2 is mounted in a caulked fashion on the front surface of the opening 1*a*'. While in the present embodiment, the ring tab 2 is not to be separated from the top plate 1*a*, it will be noted that the tab 2 may be separated therefrom.

A straw indicated at 3 has its upper end mounted in a caulked fashion on the rear side of the opening 1*a*'. While in the present embodiment, the ring tab 2 is not to be separated from the top plate 1*a*, it will be noted that the tab 2 can be separated therefrom.

Figure 2:
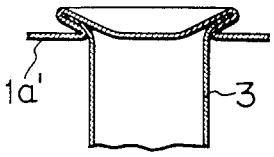
Figure 2A:
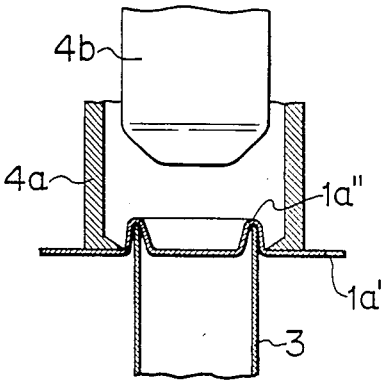
FIG. 2A is a sectional view for explaining a process of caulking a straw.

A process of caulking the straw 2 comprises, for example, as shown in FIG. 2A, inserting an upper end of the straw 3 internally into an annular groove 1*a*'' drawn to a depth of approximately 2 mm while being adjusted to the diameter of the straw 3, setting a caulking receiving bed 4*a* externally of the annular groove 1*a*'', pressing a caulking rod 4*b* from the above to crush the annular groove 1*a*'' between the rod and the bed 4*a*, and clamping the upper end of the straw 3 in the caulking state. It is to be noted that particularly in case of paper cans, composite cans, etc., the straw 2 may be mounted by adhesives or the like.

A cut-off portion 3*a* is formed in the vicinity of the aforesaid mounting portion of the straw 3. Any process of forming the cut-off portion 3 may be used. For example, perforations may be incorporated along the periphery of the straw 3 or a number of pores are bored. In short, it will suffice that the straw 3 may be bended or torn off by a finger tip to easily cut it away.

A major portion of an intermediate portion of the straw 3 is formed into a bellows 3*b* so that it may be extended to make the length of the straw 3 longer than the depth of the container 1.

The straw 3 may be extended, other than the aforesaid bellows 3*b*, by forming the straw into a coil-like configuration or by forming the straw into a double-tube which are slidably moved each other.

A stopper 5 is mounted on the lower portion of the straw 3.

The outer contour of the stopper 5 is formed to be larger than an outlet made by the tearing opening 1*a'* so that even if an attempt is made to pull out the straw 3, it cannot be pulled out because the stopper 5 has engaged with the outlet.

This stopper 5 not only prevents that straw 3 from being slipped out but is useful when the straw 3 is extended as will be described later.

The function of a float is imparted to the stopper 5 to thereby prevent the straw 3 from falling into the container 3 during the time from cutting it away from the tearing opening 1*a'* to extension thereof. Also, the straw 3 may be positioned close to the wall of the container 1, as shown by the imaginary line in FIG. 1, so as not to be hindrance when drinks are filled.

Figure 3:
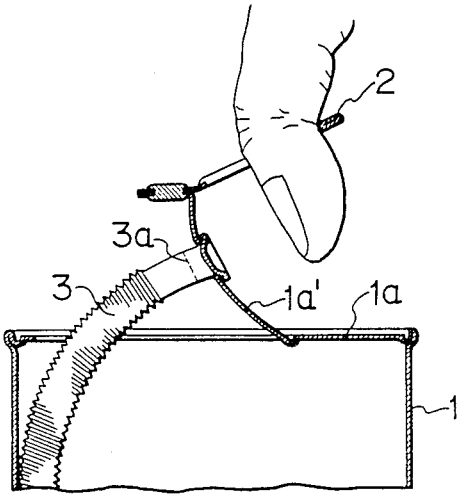
FIG. 3 is a sectional view for explaining the state wherein the tearing opening is opened.
Figure 4:
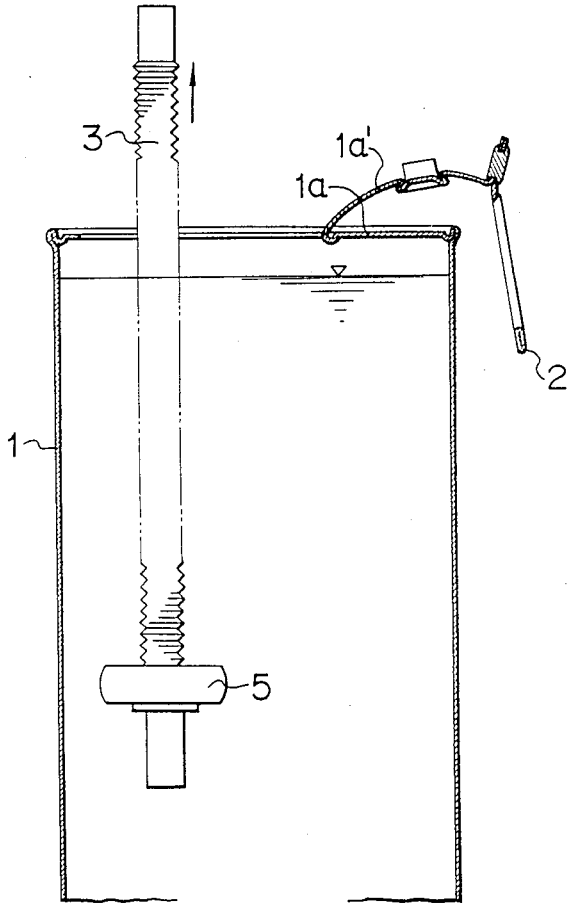
FIG. 4 is a sectional view for explaining the ascending action of straw by a float-like stopper.

Since the container according to the present embodiment is constructed as described above, when one drinks the beverage within the container, the finger is first engaged with the ring tab 2 to tear the tearing line portion of the top plate 1a to open the tearing opening 1*a'* (see FIG. 3).

When the opening 1*a'* is opened, the upper portion of the straw 3 attached to the rear side is pulled out.

Then, the underside of the cut-off portion 3*a* of the straw 3 is picked by the finger to cut away the straw 3.

After the straw 3 has been cut away, it is raised while being picked and both upper and lower portions of the straw 3 are picked to pull and extend it, or the stopper 5 is engaged with the outlet and in that state the straw 3 is pulled and extended for use.

In the event that even if the straw 3 is erroneously diengaged from the finger before the straw 3 is extended, the stopper 5 has the function as a float, the straw 3 naturally floats off and rises, and therefore, it is safe.

The present invention has the following effects.

(1) Since the upper end of the straw is mounted on the rear side of the opening of the container body, the straw may be taken out positively and easily simultaneously with the opening of the opening portion. Furthermore, since the upper end of the straw is mounted in the caulking fashion, the straw may be mounted positively and in a stabilized manner. In addition, since the cut-off portion is provided in the vicinity of the upper end of the straw, said portion may be cut into fine strips to thereby remove the straw simply and positively.

(2) Since the straw is formed into a bellows so that it may be extended, the straw may be extended simply and positively to provide easy drinking.

(3) Since the stopper is provided at the lower portion of the straw so as not to be slipped out of the outlet of the container, the stopper may be engaged with the outlet to facilitate the extension when the straw is extended.

(4) Since the stopper is provided at the lower portion so as not to be slipped out of the outlet of the container, the container may be discarded for disposal with the straw positively stayed within the container, which is useful in prevention of public hazards.

(5) Since the stopper is formed into a float, it is possible to positively prevent the straw from sinking into the container.

What is claimed is:

1. A container for beverages comprising a housing;

a straw in said housing;

a removable opening portion on the top of said housing forming an opening in said housing upon removal of said opening portion from the top of said housing;

said straw including an upper end mounted in a caulked attachment to said removable opening portion and extending from the rear side of said removable opening portion;

a cut-off portion in the vicinity of said upper end of said straw;

a body portion formed into a bellows adapted to be extensible;

a stopper formed as a float and attached at a lower portion of said straw;

said stopper being larger in size than said opening in said housing formed by removal of said removable opening portion to prevent passage of said stopper through said opening whereby said straw may be pulled to extend it in its bellow body portion while its bottom end is held within said opening in said housing to provide the opposite force to the force applied for extending the length of said straw.

* * * * *